United States Patent [19]

Conine

[11] 4,262,488

[45] Apr. 21, 1981

[54] SYSTEM AND METHOD FOR CONTROLLING THE DISCHARGE TEMPERATURE OF A HIGH PRESSURE STAGE OF A MULTI-STAGE CENTRIFUGAL COMPRESSION REFRIGERATION UNIT

[75] Inventor: Robert D. Conine, Syracuse, N.Y.

[73] Assignee: Carrier Corporation, Syracuse, N.Y.

[21] Appl. No.: 82,837

[22] Filed: Oct. 9, 1979

[51] Int. Cl.[3] ..... F25B 5/00

[52] U.S. Cl. ..... 62/117; 62/196 B; 62/510

[58] Field of Search ..... 62/117, 196 B, 510

[56] References Cited

U.S. PATENT DOCUMENTS

| | | | |
|---|---|---|---|
| 2,888,809 | 6/1959 | Rachtal | 62/217 |
| 2,921,446 | 1/1960 | Zuliyke | 62/510 |
| 3,011,322 | 12/1961 | Tzyzberger | 62/510 |
| 3,241,331 | 3/1966 | Endress et al. | 62/117 |
| 3,370,438 | 2/1968 | Hopkinson | 62/196 B |
| 3,635,041 | 1/1972 | Endress et al. | 62/117 |
| 3,744,273 | 7/1973 | Ware | 62/117 |

*Primary Examiner*—Ronald C. Capossela

*Attorney, Agent, or Firm*—J. Raymond Curtin; Donald F. Daley

[57] ABSTRACT

A system for controlling the discharge temperature of a high pressure stage of a multi-stage centrifugal compression refrigeration unit includes flow control means for maintaining a continuous flow of refrigerant through the high pressure stage regardless of changes in the heating load thereon. When the heating load on the high pressure stage decreases below a predetermined level the pressure at the suction side of the high pressure stage is substantially reduced to decrease the weight flow of refrigerant through the high pressure stage. Simultaneously, the pressure differential across the high pressure stage is substantially equalized.

13 Claims, 1 Drawing Figure

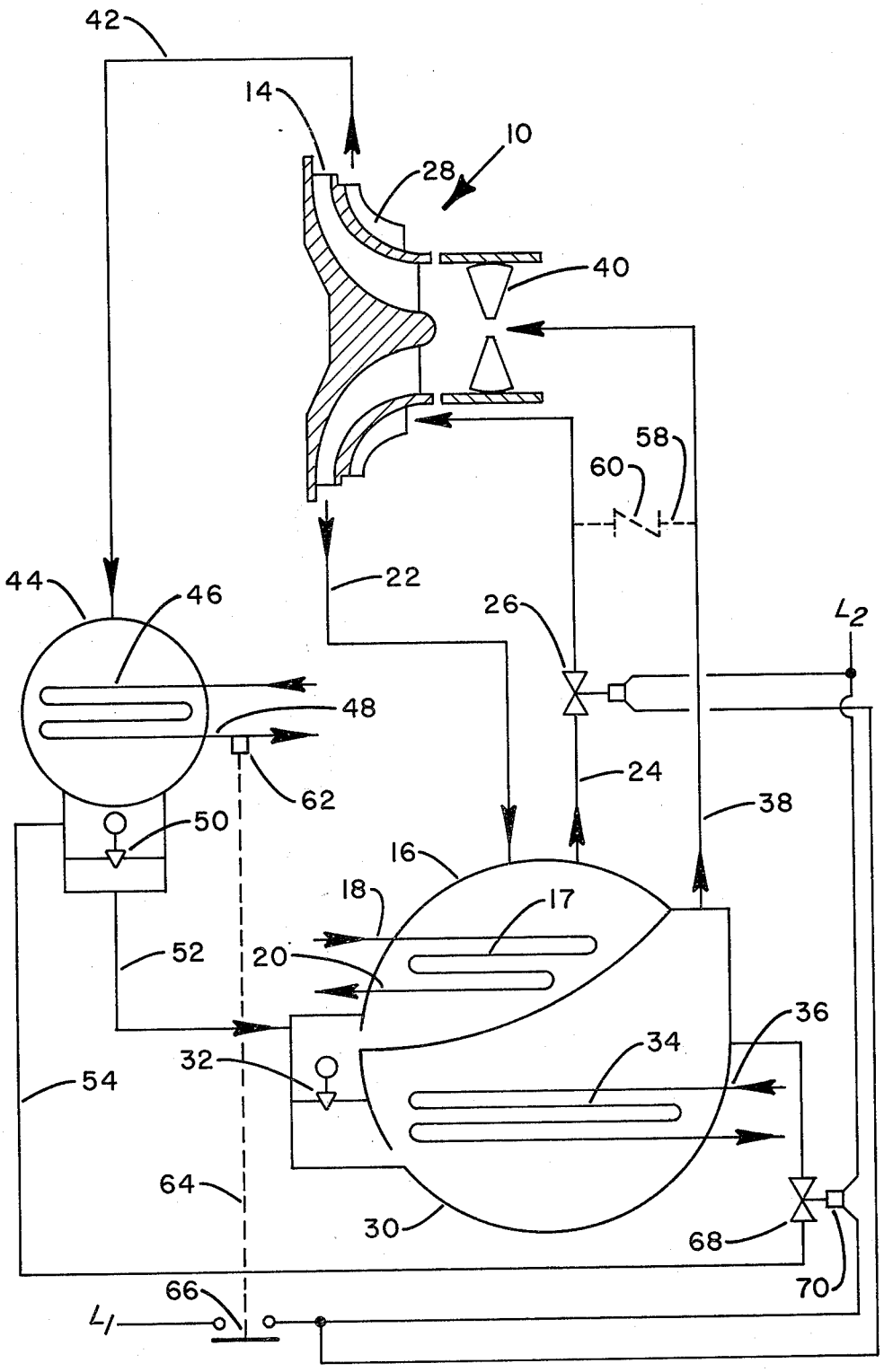
42
14
10
28
40
58
60
22
44
46
26
L2
48
62
24
38
50
16
18
17
52
20
36
34
32
54
64
30
68
70
66
L1

SYSTEM AND METHOD FOR CONTROLLING THE DISCHARGE TEMPERATURE OF A HIGH PRESSURE STAGE OF A MULTI-STAGE CENTRIFUGAL COMPRESSION REFRIGERATION UNIT

BACKGROUND OF THE INVENTION

This invention relates to a system for controlling the discharge temperature of a high pressure stage of a multi-stage centrifugal compression unit of the type utilizing relatively low pressure refrigerant discharged from a low pressure stage to satisfy a cooling load and relatively high pressure refrigerant discharged from the high pressure stage to satisfy a heating load.

In air conditioning large buildings, and in other similar applications, it is often necessary to provide cooling and heating simultaneously. For example, the outer portion of the building will require heating in cold weather to compensate for transmission losses through walls and windows; while the inner portion or core of the building will require cooling to compensate for the heat buildup in the center or unexposed portions of the building. During warm weather the heating requirement will diminish and the entire building may require cooling. In order to provide both heating and cooling, refrigeration systems have been developed which utilize a conventional centrifugal compressor, condensor and evaporator to promote cooling and which employ a second or high pressure condenser to provide heating. The heating condenser receives hot refrigerant vapor from a second or higher pressure stage of a multiple stage centrifugal compression unit. The hot vapor is condensed in the heating condenser, thereby heating water or other suitable medium to a temperature sufficient for use in heating the building.

As is fairly apparent, the heating load on the high pressure stage will not remain constant, but rather will vary in accordance with changes in the ambient temperature. However, irrespective of such changes in the heating load, it is necessary to maintain a continuous flow of refrigerant through the high pressure stage to prevent such stage from overheating. If the refrigerant furnished to the high pressure stage at relatively low heating load conditions is supplied at normal suction conditions for said stage, i.e. at the low pressure stage discharge pressure, a substantial weight flow of vapor is required, with the stage using a relatively large quantity of power to further compress the refrigerant while no useful work is being accomplished.

Although it is known that reducing the mass flow through the compressor stage will reduce the power requirements thereof, a mere reduction in such flow wthout a simutaneous decrease in the pressure differential across the stage, will cause the stage to operate near surge conditions. As is well recognized, it is undesirable to operate a centrifugal compressor at or near surge conditions due to the high discharge temperatures and mechanical vibrations that are generated at such times. If the refrigerant vapor is supplied at a much lower pressure when the heating load on the high pressure stage is reduced, the mass or weight flow of refrigerant will be concomitantly reduced thereby decreasing the consumption of wasted energy. Further, by lowering the pressure differential across the stage, while simultaneously lowering the weight flow therethrough, the compressor will be prevented from operating at or near surge conditions.

SUMMARY OF THE INVENTION

It is therefor an object of this invention to control the discharge temperature of a high pressure stage of a multi-stage vapor compression refrigeration unit.

It is a further object of this invention to minimize the power consumption of the high pressure stage when the heating load thereon decreases below a predetermined level.

It is a further object of this invention to deliver relatively low pressure, low temperature, low density refrigerant gas to the high pressure stage when the heating load thereon falls below a predetermined level.

It is yet another object of this invention to simultaneously lower the mass flow through a stage while decreasing the pressure differential thereacross when the load on the stage decreases below a predetermined level.

These and other objects of this invention are attained by a system for controlling the discharge temperature of a high pressure stage of a multi-stage centrifugal compression refrigeration unit of the type utilizing relatively low pressure refrigerant discharged from a low pressure stage to satisfy a cooling load and relatively high pressure refrigerant discharged from the high pressure stage to satisfy a heating load. The load on the high pressure stage is monitored, with a continuous flow of refrigerant through the high pressure stage being maintained regardless of changes in the heating load thereon. When the heating load upon the high pressure stage decreases below a predetermined level, the pressure differential across the stage is substantially equalized to minimize the lift requirements of the stage to reduce the work required from the stage at relatively low heating loads. Further, in a preferred embodiment, the pressure of the refrigerant gas delivered to the inlet side of the high pressure stage at relatively low heating loads is reduced to decrease the weight flow of refrigerant to minimize the horsepower input requirements of the stage.

BRIEF DESCRIPTION OF THE DRAWING

The single FIGURE of the drawing is a schematic representation of a refrigeration system embodying the present invention.

DESCRIPTION OF THE PREFERRED EMBODIMENT

Referring to the drawing, the compressor 10 illustrated in the diagram is of the two-stage centrifugal type. A high pressure impeller 28 pumps refrigerant to a high pressure condenser 44 through conduit 42. A low pressure impeller 14 pumps refrigerant to a low pressure condenser 16 through line 22. The compressor is driven through suitable motor means such as an electric motor or a steam turbine. As is well known by those skilled in the art, the compressor impellers are mounted on a shaft with rotation of the shaft causing the impellers to rotate within the compressor casing. While the preferred embodiment illustrates impeller 28 mounted in "piggyback" relationship relative to impeller 14, it is within the scope of the present invention for impellers 14 and 28 to be spaced axially along a common shaft of a single compressor or for impeller 14 to form the single stage of a first compressor and impeller 28 to form the single stage of a second compressor. The high pressure, high temperature vapor in the high pressure or heating condensor 44 heats tube bundle 46. Water or other suitable heat transfer fluid is circulated through tube bundle 46 to remote heating units (not shown) via conduit 48. Condensed liquid refrigerant is returned from condenser 44 to the cooler or evaporator 30 through piping 52 and orifice means 50.

The low pressure condenser 16 and the cooler or evaporator 30 are preferably enclosed within a single enclosure or housing. The condensing portion 16 of the housing receives refrigerant flow from the low pressure impeller 14 through piping 22. A cooling medium is circulated through tube bundle 17 located within low pressure condenser. The tube bundle is in heat transfer relation with the refrigerant vapor and cools and condenses the refrigerant.

The condensed refrigerant in the low pressure condenser 16 flows through an orifice 32 and into the evaporator or cooler means 30. The evaporator, as shown, is contained within the bottom portion of the single housing and contains tube bundle 34. A cooling medium, usually water, is circulated through piping 36 into the tube bundle, where it is cooled and returned to the air conditioning system (not shown). Vaporized refrigerant within cooler 30 is drawn off into the low pressure stage of compressor 10 through line 38 and guide vanes 40. The refrigerant leaving low pressure stage 14 of compressor 10 passes to condenser 16 through line 22 and a portion thereof is then drawn from the condenser to the inlet of the high pressure stage through line 24. Line 24 preferably has a valve 26 disposed therein for a reason to be more fully explained hereinafter.

Line 54 directly connects high pressure condenser 44 with cooler 30. In effect, line 54 provides a by-pass about orifice means 50. A valve 68 is disposed in line 54 for controlling the flow of refrigerant therethrough. Valve 68 is preferably electrically operated through the energization of coil 70 thereof. Coil 70 will be energized upon the closure of switch 66 which connects coil 70 to a source of electrical power represented by lines L-1 and L-2. Switch 66 will be closed in response to an electrical signal provided from signaling means 62. Preferably signaling means 62 senses the temperature of the medium discharged from tube bundle 46 and provides a signal to close switch 66 when the temperature of the medium exceeds a predetermined level. The refrigeration system described above is operable to both heat and/or cool occupied spaces. The cooling load on the system will vary depending upon the ambient temperature; however, there will exist at least a minimum cooling load during the entire year. The heating load on the system will also vary with ambient temperature; however during relatively high temperature ambient conditions the heating load on the system will be entirely extinguished. Since high pressure stage 28 is directly coupled to and rotatable with low pressure stage 14, the high pressure stage will continue to operate irrespective of the heating load on the refrigeration system. If refrigerant flow through high pressure stage 28 were to be eliminated when the heating load on the system has been extinguished, the stage will operate at unacceptably high discharge temperatures. Thus, it is necessary to maintain at least a minimum flow of refrigerant through high pressure stage 28 irrespective of the heating load thereon.

If the minimum flow of refrigerant vapor to high pressure stage were furnished at the discharge pressure from primary or low pressure stage 14, a substantial weight flow of vapor would be required to maintain the temperature of the high pressure stage below a predetermined maximum level. The high pressure stage would use a substantial amount of power in further compressing the vapor passing therethrough while producing no useful work. However, if the minimum flow of vapor were supplied to high pressure stage 28 from a relatively low pressure source, the required weight flow of vapor could be reduced producing a concomitant reduction in the wasted power consumption. Further, to reduce the horsepower requirements of the compressor 10 when the heating load on the high pressure stage 28 has been extinguished, the discharge side of the stage is placed under a relatively low pressure to minimize the lift requirements on the stage.

When temperature sensor 62 senses that the temperature of the fluid leaving tube bundle 46 exceeds a predetermined level indicative of the heating load on the system being reduced to a relatively low point, the sensor generates a signal to close switch 66 for energizing coil 70 and opening valve 68. A further signal will be delivered to valve 26 to substantially close the valve. When valve 26 is placed in its substantially closed position, it will permit a minimum flow of refrigerant through conduit 24 to the suction side of high pressure stage 28. With valve 68 open, the by-pass flow path is established through line 54 about orifice means 50. High pressure condenser 44 is thus directly placed in communication with cooler 30 whereby the pressure within condenser 44 is lowered to substantially cooler pressure. The pressure which high pressure stage 28 must exceed to generate flow is thereby substantially reduced. Further, through the substantial closing of valve 26, the pressure of the vapor delivered through line 24 to the suction side of stage 28 is substantially reduced thereby minimizing the required weight flow of refrigerant for maintaining the temperature of the high pressure stage below the maximum level.

By placing the discharge side of the high pressure stage 28 at substantially cooler pressure and substantially reducing the pressure of the refrigerant vapor flowing through the suction side of the stage, the lift requirements of the stage are minimized while the weight flow of the refrigerant required to maintain the temperature of the stage below the safe operating point is reduced, substantially decreasing the consumption of wasted power when the heating load on the refrigeration system has been substantially diminished. In effect, the pressure differential across the high pressure stage has been substantially equalized, with the pressure being reduced to approximately the lowest level within the refrigeration unit.

As an alternate to permitting a minimum flow of refrigerant through valve 26 as described above, valve 26 may be entirely closed upon the opening of valve 68. In this embodiment a line 58 having a check valve 60 will communicate line 38 with line 24 downstream of valve 26. When valve 26 entirely closes, the pressure in the line downstream thereof will be substantially reduced thereby causing check valve 60 to open to permit refrigerant flow from line 38 to the inlet side of high pressure stage 28. With the opening of check valve 60, stage 28 will receive the necessary refrigerant flow for maintaining the stage at a safe operating temperature. The flow of refrigerant through line 58 at substantially the suction pressure of stage 14 will provide the requisite low pressure refrigerant vapor to the inlet of the high pressure stage. Further, as the temperature of the vapor delivered through conduit 58 is at generally the lowest level within the refrigeration unit, the operating temperature of high pressure stage 28 will be significantly reduced.

The foregoing arrangement suitably decreases the consumption of wasted power when the heating load on a refrigeration system is diminished, yet maintains a requisite flow of refrigerant through the high pressure heating stage.

While preferred embodiments of the present invention have been described and illustrated the invention should not be limited thereto but may be otherwise embodied within the scope of the following claims.

I claim:

1. A system for controlling the discharge temperature of a high pressure stage of a multi-stage centrifugal compression refrigeration unit of the type utilizing relatively low pressure refrigerant discharged from a low pressure stage to satisfy a cooling load and relatively high pressure refrigerant discharged from a high pressure stage to satisfy a heating load comprising:

means for maintaining a continuous flow of refrigerant through said high pressure stage regardless of changes in the heating load thereon; and refrigerant flow control means responsive to the changes in the heating load on the high pressure stage for substantially equalizing the pressure between the inlet and discharge sides of said high pressure stage when the load on said high pressure stage decreases below a predetermined level.

2. A system in accordance with claim 1 wherein said refrigerant flow control means includes:

a first conduit communicating refrigerant condensing means for receiving the relatively high pressure refrigerant gas discharged from said high pressure stage when refrigerant evaporator means of said refrigeration unit;

a first normally closed valve interposed in said first conduit for controlling refrigerant flow from said condensing means to said evaporator means; and load sensing means for opening said normally closed valve when the load on the high pressure stage decreases below the predetermined level for enabling refrigerant to flow from said condensing means to said evaporator means for substantially equalizing the pressure therebetween.

3. A system in accordance with claims 1 or 2 wherein said flow maintaining means includes:

means for delivering refrigerant at substantially the suction pressure of the low pressure stage to the inlet side of said high pressure stage when the heating load on said high pressure stage falls below said predetermined level.

4. A system in accordance with claim 3 wherein said refrigerant delivering means includes:

a second conduit connecting the suction side of the low pressure stage with the suction side of the high pressure stage;

a normally closed second valve interposed in said second conduit for controlling flow of refrigerant through said second conduit; and means for opening said normally closed second valve upon the opening of said first normally closed valve.

5. A system for controlling the discharge temperature of a high pressure stage of a multi-stage centrifugal compression refrigeration unit of the type utilizing relatively low pressure refrigerant discharged from a low pressure stage to satisfy a cooling load and relatively high pressure refrigerant discharged from the high pressure stage to satisfy a heating load comprising:

means for maintaining a continuous flow of refrigerant through said high pressure stage regardless of changes in the heating load thereon;

refrigerant flow control means responsive to changes in the heating load on the high pressure stage including pressure reducing means for reducing the pressure of the refrigerant delivered to the suction side of the high pressure stage;

pressure equalizing means for substantially equalizing the pressure between the suction and discharge sides of the high pressure stage; and actuating means for simultaneously activating said pressure reducing means and said pressure equalizing means when the load on said high pressure stage decreases below a predetermined level.

6. A system in accordance with claim 5 wherein said pressure reducing means includes:

means for delivering refrigerant at substantially the suction pressure of the low pressure stage to the suction side of said high pressure stage when the heating load on said high pressure stage falls below said predetermined level.

7. A system in accordance with claim 6 wherein said refrigerant delivering means includes:

a conduit connecting the suction side of the low pressure stage with the suction side of the high pressure stage;

a normally closed valve interposed in said conduit means for controlling flow of refrigerant through said second conduit; and means for opening said normally closed valve upon the activation of said pressure equalizing means.

8. A method of controlling the discharge temperature of a high pressure stage of a multi-stage centrifugal compression refrigeration unit of the type utilizing relatively low pressure refrigerant discharged from a low pressure stage to satisfy a cooling load and relatively high pressure refrigerant discharged from the high pressure stage to satisfy a heating load comprising the steps of:

monitoring the heating load on the high pressure stage;

maintaining a continuous flow of refrigerant through said high pressure stage regardless of changes in the heating load thereon;

substantially equalizing the pressure between the inlet and discharge sides of the high pressure stage when the heating load thereon falls below a predetermined level; and simultaneously decreasing the pressure at the inlet side of the high pressure stage for reducing the weight flow of refrigerant through the high pressure stage.

9. A method in accordance with claim 8 wherein the equalizing step includes:

placing the discharge side of the high pressure stage in communication with the inlet side of the low pressure stage for substantially decreasing the pressure of said discharge side of said high pressure stage.

10. A method in accordance with claim 9 further including the step of:

communicating the inlet sides of the low pressure and high pressure stages for delivering refrigerant gas at the pressure of the inlet side of the low pressure stage to the inlet side of the high pressure stage when the heating load on the high pressure stage falls below said predetermined level.

11. A system for controlling the discharge temperature of a high pressure stage of a multi-stage centrifugal compression refrigeration unit of the type utilizing relatively low pressure refrigerant discharged from a low pressure stage to satisfy a cooling load and relatively high pressure refrigerant discharged from the high pressure stage to satisfy a heating load comprising:

a first condenser for receiving the relatively low pressure refrigerant discharged from the low pressure stage of said centrifugal compression refrigeration unit;

a second condenser for receiving the relatively high pressure refrigerant discharged from the high pressure stage of said centrifugal compression refrigeration unit;

an evaporator for receiving condensed refrigerant from said first and second condensers;

a first conduit including expansion means for defining a first refrigerant flow path from said first and second condenser to said evaporator;

a first by-pass conduit including a first normally closed valve for defining a second refrigerant flow path from said second condenser to said evaporator; and actuating means responsive to the heating load on said relatively high pressure stage for opening said normally closed valve when the heating load decreases below a predetermined level for enabling refrigerant to flow from said second condenser to said evaporator through said by-pass conduit.

12. A system in accordance with claim 11 further including:

flow control means for delivering relatively low pressure refrigerant to the inlet side of said high pressure stage when the heating load on said stage falls below said predetermined level.

13. A system in accordance with claim 12 wherein said flow control means includes:

a second conduit connecting the suction side of the low pressure stage with the suction side of the high pressure stage;

a normally closed second valve interposed in said second conduit for controlling flow of refrigerant therethrough; and means for opening said second normally closed valve upon the opening of said first normally closed valve for enabling refrigerant gas at the suction pressure of said low pressure stage to flow to the suction side of said high pressure stage.

* * * * *